US011766155B2

(12) United States Patent
Terry

(10) Patent No.: US 11,766,155 B2
(45) Date of Patent: Sep. 26, 2023

(54) PORTABLE OUTDOOR TOILET SEAT APPARATUS

(71) Applicant: Joshua Gerald Terry, Porter, OK (US)

(72) Inventor: Joshua Gerald Terry, Porter, OK (US)

( * ) Notice: Subject to any disclaimer, the term of this patent is extended or adjusted under 35 U.S.C. 154(b) by 0 days.

(21) Appl. No.: 17/871,965

(22) Filed: Jul. 24, 2022

(65) Prior Publication Data

US 2023/0025297 A1 Jan. 26, 2023

Related U.S. Application Data

(60) Provisional application No. 63/225,478, filed on Jul. 24, 2021.

(51) Int. Cl.
*A47K 13/00* (2006.01)
*A47K 13/26* (2006.01)

(52) U.S. Cl.
CPC ..... *A47K 13/005* (2013.01); *A47K 13/26* (2013.01)

(58) Field of Classification Search
CPC ..... A47K 13/005; A47K 13/26
USPC ..... 4/237
See application file for complete search history.

(56) References Cited

U.S. PATENT DOCUMENTS

| | | | |
|---|---|---|---|
| 5,083,324 | A | 1/1992 | Strong |
| 6,125,480 | A | 10/2000 | Soffar et al. |
| 6,546,569 | B2 | 4/2003 | Figueras |
| 10,827,887 | B2 | 11/2020 | Gombar |

*Primary Examiner* — Christine J Skubinna
(74) *Attorney, Agent, or Firm* — Technology Law, PLLC

(57) ABSTRACT

A toilet seat apparatus for use outdoors includes a toilet seat and a clamp assembly attached to the toilet seat via hinges. The clamp assembly includes two jaw members for exerting a compressive clamping force on a tree to support the toilet seat above the ground. The clamp assembly also includes a drive mechanism to control the distance between the two jaw members and the clamping force. The major components of the clamp assembly are coplanar with one another so that when the clamp assembly is rotated about the hinges, the dimensions of the toilet seat apparatus are substantially minimized.

4 Claims, 4 Drawing Sheets

PORTABLE OUTDOOR TOILET SEAT APPARATUS

CROSS-REFERENCE TO RELATED APPLICATION

This application claims the benefit of U.S. Provisional Patent Application No. 63/225,478, filed Jul. 24, 2021, and which is hereby incorporated by reference in its entirety.

TECHNICAL FIELD

This disclosure relates generally to portable toilets.

BACKGROUND

The use of a supportive toilet seat as found in bathrooms greatly aids in comfort during defecation. However, people who spend long periods of time in remote wilderness areas, such as hunters and campers, are confronted with the absence of bathroom facilities in nature and forego the benefits of supportive toilet seats.

SUMMARY

A toilet seat apparatus is provided for use in remote areas that do not have bathroom facilities. The toilet seat apparatus includes a toilet seat and a clamp. The toilet seat includes a plurality of segments that define a slot or opening. The clamp assembly includes first and second jaw members that are spaced a distance apart from one another and configured to engage a tree or other vertically-oriented structure to support the toilet seat above the ground. The clamp assembly also includes a drive mechanism that is operatively connected to the first and second jaw members and configured to vary the distance between the first and second jaw members.

The drive mechanism and first and second jaw members are coplanar about a first plane, and the segments of the toilet seat are coplanar about a second plane. The toilet seat is pivotably connected to the clamp such that the clamp is rotatable relative to the toilet seat between a compact position and an extended position. In the compact position, the clamp assembly and the toilet seat are in juxtaposition with one another and the first and second planes are substantially parallel to one another. Accordingly, the toilet seat apparatus improves upon the prior art by minimizing its length dimension when the toilet seat is in the compact position, thereby making transportation of the toilet seat apparatus more convenient, which is very important when travelling to remote areas where the toilet seat apparatus may be used.

Furthermore, in one embodiment, the drive mechanism is a screw drive mechanism having a drive screw and a drive nut. The drive nut is mounted with respect to the first clamp member for unitary movement therewith. The drive screw is engaged with the drive nut such that rotation of the drive screw causes linear translation of the drive nut and the first clamp member, thereby altering the distance between the first and second clamp members.

Thus, the toilet seat assembly provided herein also improves upon the prior art by enabling the device to be securely mounted to trees of various diameters with a simple action (i.e., rotating the handle). Furthermore, the use of the screw drive eliminates the need for the complexity and added mass of a locking mechanism to retain the jaws in their desired positions, because the screw drive is self-locking, i.e., the screw drive will only permit movement of the jaws relative to one another through the rotation of the screw/handle.

Accordingly, the toilet seat assembly provided herein is easily transportable, lightweight, easy to use, and is mountable to trees of varying sizes.

A corresponding method of using the toilet seat apparatus is also provided.

The above features and advantages and other features and advantages of the present disclosure are readily apparent from the following detailed description of the best modes for carrying out the disclosure when taken in connection with the accompanying drawings.

DETAILED DESCRIPTION

Figure 1:
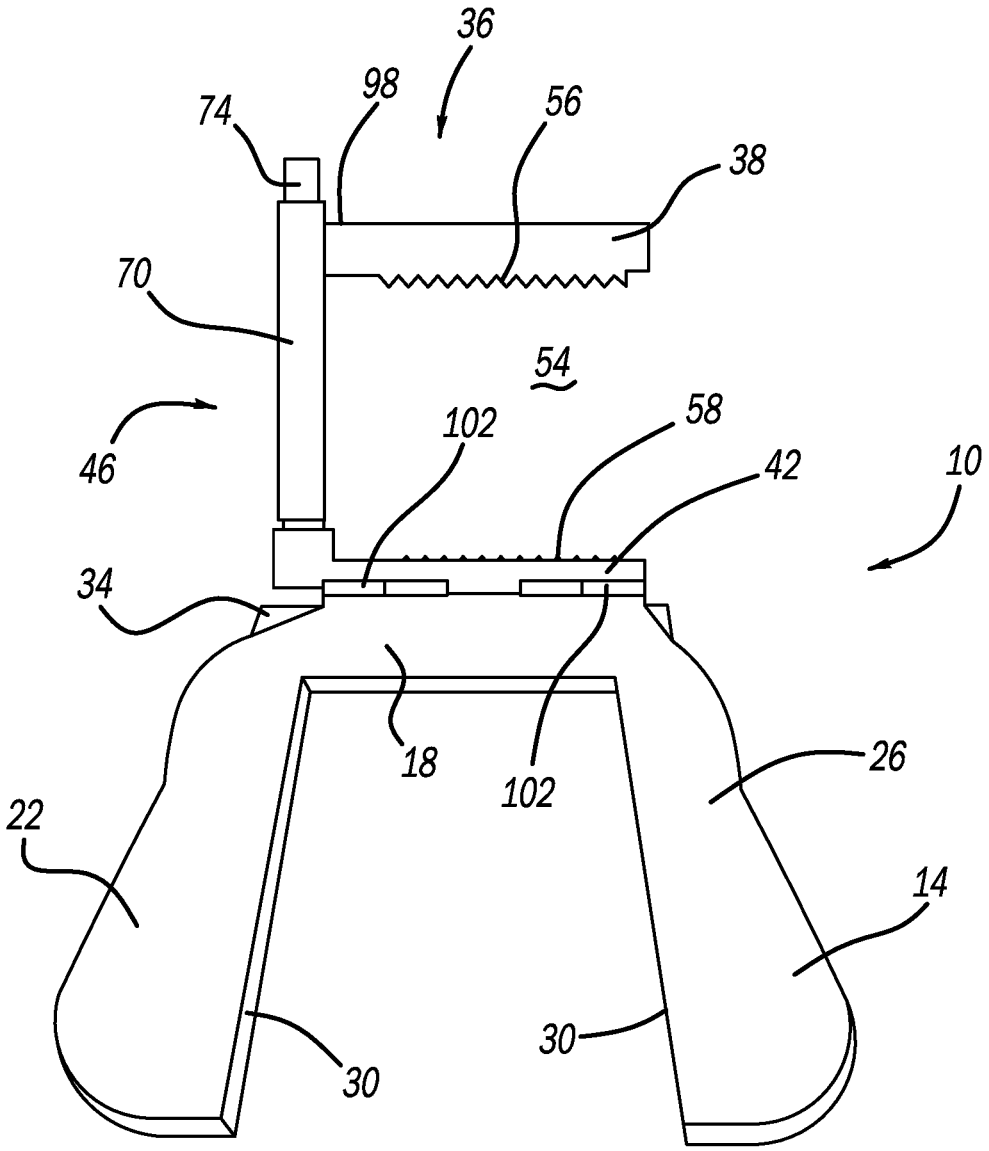
FIG. 1 is a schematic, perspective, front view of a portable toilet seat assembly.
Figure 2:
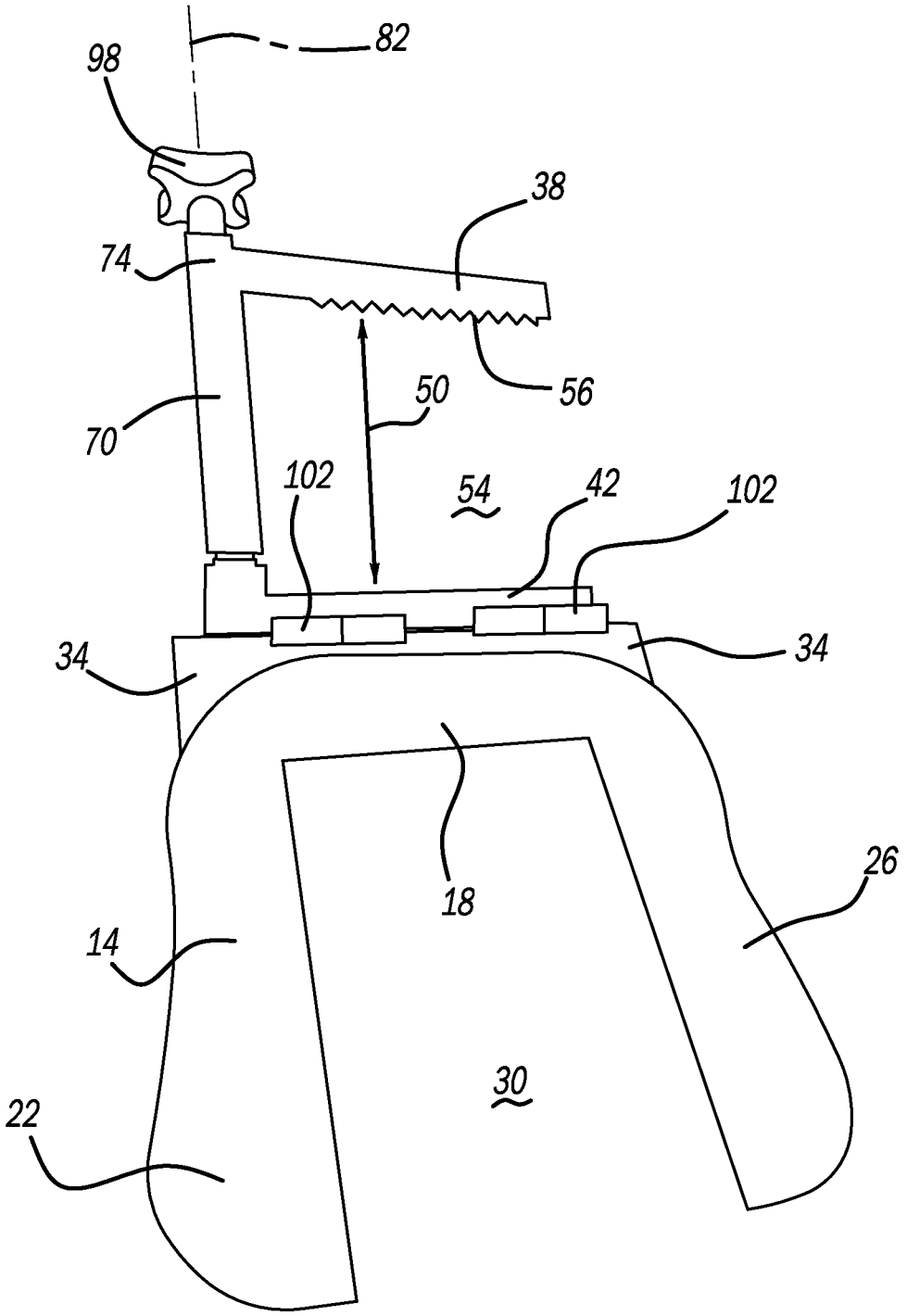
FIG. 2 is a schematic, perspective view of the portable toilet seat assembly of FIG. 1.

Referring to the Figures, wherein like reference numbers refer to like components throughout, a portable toilet seat assembly 10 is schematically depicted. The portable toilet seat assembly 10 includes a toilet seat 14. In the embodiment depicted, the toilet seat 14 includes a first segment 18, a second segment 22, and a third segment 26. The second segment 22 and the third segment 26 are spaced apart from one another and substantially parallel to one another. Each of the second segment 22 and the third segment 26 extends perpendicularly from the first segment 18. Accordingly, the toilet seat 14 is generally U-shaped, with the first, second, and third segments 18, 22, 26 cooperating to define a slot or opening 30. In the embodiment depicted, the assembly 10 also includes a support member 34 that is rigidly connected to the toilet seat 14 and, more specifically, extends parallel to the first segment 18.

Although a U-shaped toilet seat 14 is employed in the embodiment depicted, those skilled in the art will recognize a variety of toilet seat configurations that may be employed within the scope of the claimed invention. For example, and without limitation, the toilet seat 14 may be annular, an oblong annulus, etc.

The portable toilet seat assembly 10 also includes a clamp assembly 36. The clamp assembly 36 includes a first jaw member 38, a second jaw member 42, and a drive screw mechanism 46 that is configured to translate one of the jaw members 38, 42 so that the distance 50 between the jaw members 38, 42 is selectively variable. More specifically, the first jaw member 38 is substantially parallel with the first segment 18 of the toilet seat 14. The second jaw member 42 extends substantially parallel to the first jaw member 38.

Figure 3:
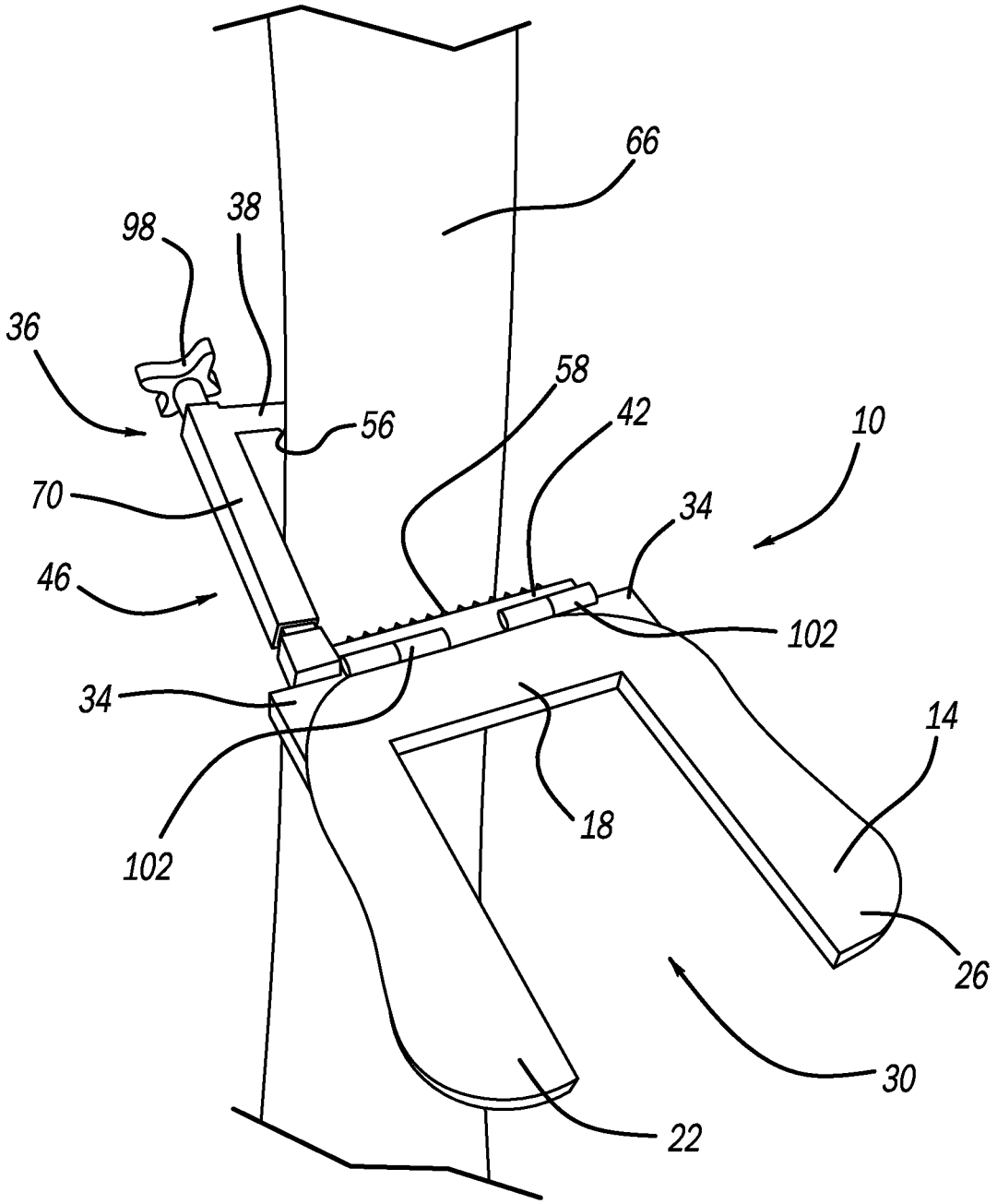
FIG. 3 is a schematic, perspective view of the portable toilet seat assembly of FIGS. 1 and 2 mounted to a tree.

In the embodiment depicted, each of the jaw members 38, 42 has a respective serrated surface 56, 58 that partially defines the open space 54 between the jaw members 38, 42. The serrated surfaces 56, 58 are positioned such that when a tree 66 extends through the open space 54, as shown in FIG. 3, the serrated surfaces 54, 58 face the tree 66. The clamp assembly 36 includes a stationary member, such as the housing 70 of the drive screw mechanism 46. In the embodiment depicted, the housing 70 is a hollow tube having a square cross-sectional shape and that extends substantially perpendicularly with respect to the jaw members 38, 42. The first jaw member 38 is rigidly mounted with respect to the housing 70, such as by welding.

The drive screw mechanism 46 further includes a drive screw (as shown in phantom at 74 in FIGS. 4 and 5), which is also sometimes referred to as a "lead screw" by those skilled in the art. The drive screw 74 is generally cylindrical and has external helical threads 78. The drive screw 74 extends at least partially inside the housing 70 and is rotatably mounted thereto such that the drive screw 74 is selectively rotatable about an axis 82.

Figure 4:
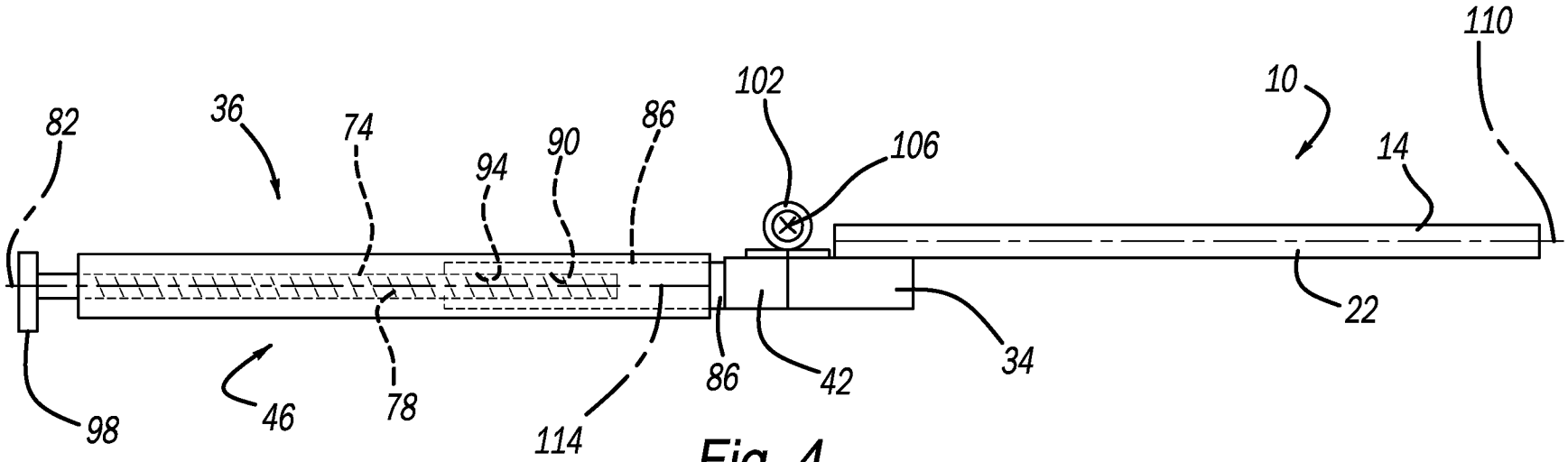
FIG. 4 is a schematic, side view of the portable toilet seat assembly in an extended configuration.
Figure 5:
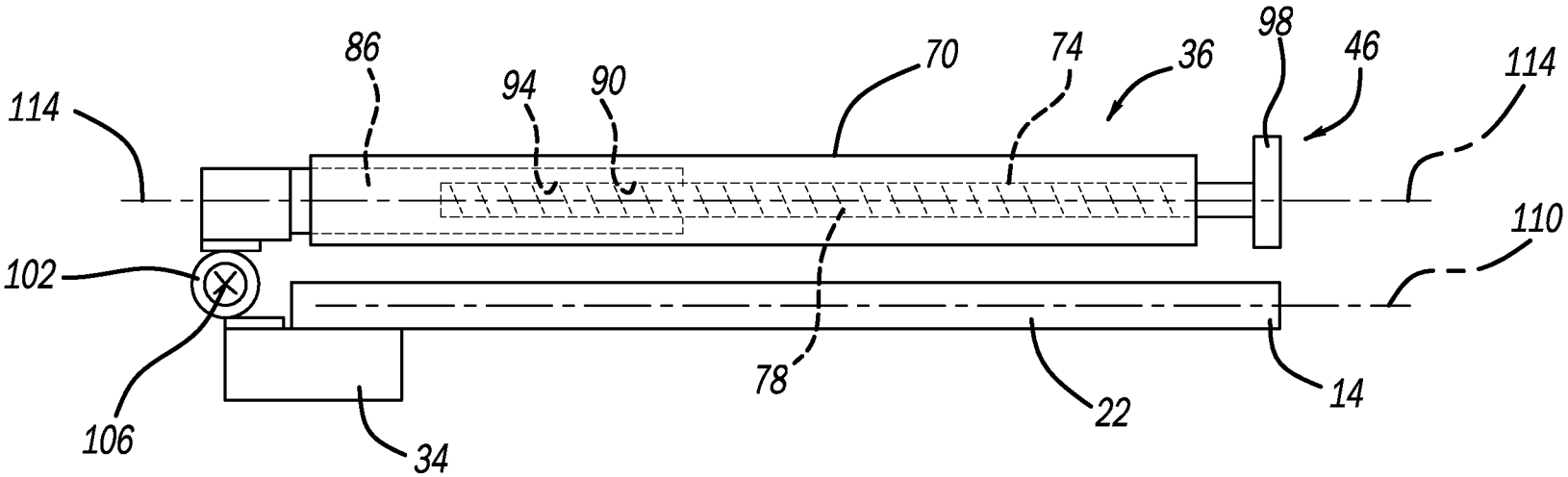
FIG. 5 is a schematic, side view of the portable toilet seat assembly in a compact configuration.

The drive screw mechanism 46 further includes a drive nut member (as shown in phantom at 86 in FIGS. 4 and 5). The drive nut member 86 is operatively connected to the housing 70 such that movement of the drive nut member 86 relative to the housing 70 is substantially limited to linear translation along axis 82. More specifically, the drive nut member 86 is positioned within the housing 70 such that physical part interference between the housing 70 and the drive nut member 86 prevents movement of the member 86 relative to the housing 70 except linear movement along the axis 82.

The drive nut member 86 defines a cylindrical hole or bore 90 having the axis 82 at its centerline. The member 86 defines internal helical threads 94 inside the bore 90. The drive screw 74 extends into the bore 90 such that the external threads 78 of the drive screw 74 engage the internal threads 94 of the drive nut member 86. Accordingly, rotation of the drive screw 74 about axis 82 causes linear translation of the drive nut member 86 relative to the housing 70 and the first jaw member 38, which is mounted with respect to the housing 70.

The second jaw member 42 is mounted to the drive nut member 86 for movement therewith, and thus rotation of the drive screw 74 also causes linear translation of the second jaw member 42 relative to the housing 70 and the first jaw member 38. Accordingly, the distance 50 between the jaw members 38, 42 is variable by rotating the drive screw 74. The clamp assembly 36 includes a handle 98 mounted to the drive screw 74 outside of the housing 70 to facilitate rotation of the drive screw 74 by a user of the toilet seat assembly 10.

The clamp assembly 36 and the toilet seat 14 are rotatably connected to each other, such as by hinges 102. More specifically, in the embodiment depicted, the hinges 102 interconnect the toilet seat support member 34 and the second jaw member 42 such that the clamp assembly 36 is rotatable relative to the toilet seat 14 about an axis 106. Axis 106 in the embodiment depicted is substantially perpendicular to axis 82.

The toilet seat 14 is rotatable relative to the clamp assembly 36 between an extended position, as shown in FIG. 4, and a compact or stowed position, as shown in FIG. 5. The length of the toilet seat assembly 10 is significantly smaller when the toilet seat 14 is in the stowed position than when the toilet seat 14 is in the extended position. Segments 18, 22, 26 of the toilet seat are coplanar about a first plane 110, i.e., segments 18, 22, 26 all cross or intersect the first plane 110. The housing 70, drive screw 74, and jaw members 38, 42 are coplanar about a second plane 114, i.e., cross or intersect the second plane 114. When the toilet seat 14 is in the compact position, the first and second planes 110, 114 are substantially parallel to one another.

Accordingly, the coplanar arrangement of the toilet seat 14 and the coplanar arrangement of the major portions of the clamp assembly 36, combined with the positioning of the hinges 102, permit a compact configuration of the toilet seat assembly 10 as shown in FIG. 5 that substantially minimizes both the length and the height of the assembly 10 for efficient transportation and storage of the toilet seat assembly 10.

In one method of using the toilet seat apparatus 10, a user will transport the toilet seat apparatus 10 in its compact configuration as shown in FIG. 5 to a desired location having a vertical structure such as the tree shown at 66 in FIG. 3. The desired location will typically be a remote, outdoor location such as near a hunting blind, hunting stand, or campsite, though any desired location may be employed within the scope of the claimed invention.

The method will also include rotating the clamp assembly 36 relative to the toilet seat 14 such that the toilet seat assembly 10 is in an extended configuration, such as the one shown in FIG. 4. In the embodiment shown, the clamp assembly 36 is rotated approximately 180 degrees relative to the toilet seat 14 in moving the assembly 10 from the compact configuration to the extended configuration; however, it should be noted that in some embodiments, and within the scope of the claimed invention, the angle formed between the clamp assembly 36 and the toilet seat 14 (i.e., between planes 110, 114) when the assembly 10 is in the extended configuration could be smaller than 180 degrees; for example, the angle may be between 135 degrees and 180 degrees.

In the event that the tree 66 is wider than the distance 50 between the first and second jaw members 38, 42, the method may also include rotating the drive screw 74, such as by rotating the handle 98, about axis 82 in a direction that will result in the distance 50 being greater than the width of the tree 66. The method further includes moving the assembly 10 such that the tree 66 is within the open space 54 between the first and second jaw members 38, 42, as shown in FIG. 3. The method further includes rotating the drive screw 74, such as by rotating the handle 98, about axis 82 in a direction that will reduce the distance 50 between the jaw members 38, 42 until the jaw members 38, 42 exert a compressive, clamping force on the tree 66 sufficient to support the toilet seat 14 and the weight of the user sitting on the toilet seat 14.

The user may also remove the toilet seat assembly 10 from the tree 66 by rotating the handle 98 to eliminate the clamping force exerted on the tree 66 and then rotate the clamping assembly relative to the toilet seat such that the assembly 10 is in the compact configuration for easy transport home.

While the best modes for carrying out the disclosure have been described in detail, those familiar with the art to which this disclosure relates will recognize various alternative designs and embodiments for practicing the disclosure within the scope of the appended claims.

The invention claimed is:

1. A toilet seat apparatus comprising:

a toilet seat having segments defining a slot or aperture;

a clamp assembly having a first jaw member, a second jaw member spaced a distance apart from the first jaw member, and a drive mechanism operatively interconnecting the first and second jaw members and configured to selectively move the second jaw member relative to the first jaw member; and at least one hinge rotatably interconnecting the toilet seat and the clamp assembly such that the clamp assembly is rotatable relative to the toilet seat;

wherein the segments of the toilet seat are coplanar about a first plane;

wherein the first jaw member, the second jaw member, and the drive mechanism are coplanar about a second plane; and wherein the clamp assembly is rotatable about the hinge between a first position in which the first and second planes are substantially parallel with one another, and a second position in which the clamp assembly is rotated between 135 degrees and 180 degrees relative to the toilet seat from the first position.

2. The toilet seat apparatus of claim 1, wherein the drive mechanism is a screw drive mechanism including a drive screw with external helical threads and a drive nut member;

wherein the drive nut member has internal helical threads and is mounted with respect to the second jaw member for movement therewith;

wherein the external helical threads of the drive screw are in engagement with the internal helical threads of the drive nut member such that rotation of the drive screw causes linear translation of the drive nut member and the second jaw member and causes the distance between the first and second jaw members to change.

3. The toilet seat apparatus of claim 2, further comprising a hollow tube being rigidly mounted with respect to the first jaw member;

wherein the drive screw is at least partially disposed within the hollow tube; and wherein the drive nut member is at least partially disposed within the hollow tube such that the hollow tube limits movement of the drive nut relative to the hollow tube to linear translation.

4. A method comprising:

possessing the toilet seat apparatus of claim 2;

rotating the clamp assembly from the first position to the second position relative to the toilet seat;

rotating the drive screw in a first rotational direction to cause the distance between the first and second jaw members to increase;

moving the toilet seat apparatus such that a tree extends between the first and second jaw members; and rotating the drive screw in a second rotation direction to cause the distance between the first and second jaw members to decrease and such that the first and second jaw members exert a clamping force on the tree.

* * * * *